US007749452B2

(12) United States Patent
Brem et al.

(10) Patent No.: US 7,749,452 B2
(45) Date of Patent: Jul. 6, 2010

(54) SAMPLE AND REACTION CONTAINER

(75) Inventors: William Brem, Hedingen (CH); Lars Rominger, Edlibach (CH)

(73) Assignee: GEMU GmbH, Rotkreuz (CH)

( * ) Notice: Subject to any disclaimer, the term of this patent is extended or adjusted under 35 U.S.C. 154(b) by 707 days.

(21) Appl. No.: 11/626,952

(22) Filed: Jan. 25, 2007

(65) Prior Publication Data

US 2008/0181824 A1 Jul. 31, 2008

(51) Int. Cl.
*B01L 3/00* (2006.01)
*B01L 3/14* (2006.01)

(52) U.S. Cl. ..... 422/102; 422/99; 206/815; 215/237

(58) Field of Classification Search ..... 422/102
See application file for complete search history.

(56) References Cited

U.S. PATENT DOCUMENTS 4,755,356 A * 7/1988 Robbins et al. ..... 422/102
5,225,165 A 7/1993 Perlman et al.
5,270,011 A 12/1993 Altherr et al.
5,690,246 A 11/1997 Anderson et al.
5,863,791 A 1/1999 Baldszun et al.
6,265,225 B1 * 7/2001 Otto et al. ..... 436/180
6,783,025 B2 * 8/2004 Lohn ..... 220/806
2006/0228264 A1 10/2006 Garvin et al.

OTHER PUBLICATIONS

European Search Report; EP 1 671 701 A1; Apr. 22, 2005.
European Office Action.

* cited by examiner

*Primary Examiner*—Jill Warden
*Assistant Examiner*—Jennifer Wecker
(74) *Attorney, Agent, or Firm*—Antonelli, Terry, Stout & Kraus, LLP.

(57) ABSTRACT

A test tube or laboratory/reaction tube (11) has a sample receptacle (12) having an opening (13) and an integrally joined cap (15) that can be set down on the opening by bending over at least one strip (17) connecting the cap to the receptacle. A tab (19) is provided on the cap projecting laterally from the side of the cap in the direction of the at least one connecting strip so as to overlap a bent portion of the at least one connecting strip after bending and setting the cap down on the opening.

8 Claims, 3 Drawing Sheets

SAMPLE AND REACTION CONTAINER

TECHNICAL FIELD

The present invention relates to a test tube or a reaction or laboratory tube with sample receptacle and integrally joined cap that can be set down on the opening of the tube by bending over at least one strip connecting the cap to the receptacle.

BACKGROUND

In medicine in particular, so-called test tubes or reaction tubes are usually arranged in multiple racks or holders to hold pipetted samples, for example, or to store them for subsequent tests or analyses. The capacity of these tubes is of the order of magnitude of 10 to 100 μL (microliters), for example. These tubes are made of a suitable polymeric material and generally have a cap integrally joined to the actual tube, which is connected to the tube through a flexible connector. The cap can be placed on the tube by bending this connector.

One of the drawbacks of the known test tube/reaction tube is that the inscriptions on these tubes, and especially any marks made on them, are extremely difficult to read. Also, the tube has to be removed from the rack or the holder to remove or to replace the cap, and both hands are generally needed to do this.

Therefore, it is the goal of this invention to propose a test tube/reaction tube with which the drawbacks and problems described above can be overcome.

BRIEF DESCRIPTION

The invention proposes a test tube or laboratory/reaction tube of the aforementioned type characterized in that there is a tab on the cap projecting laterally that projects from the side of the cap in the direction of the connecting strips after bending and setting the cap down on the opening.

The test tube proposed by the invention again provides for a sample receptacle or a tube body and a cap integrally joined to it that can be placed on the opening of the tube by bending at least one flexible strip connecting it to the receptacle. In addition, a laterally projecting tab is provided that projects from the side of the opening after the bending and placement of the cap on the opening. In other words, the face of the cover is made additionally to project from the side of the cap like a tab.

According to a variant of the design, this laterally projecting tab is made to project in the direction of the connecting strip(s).

It is also proposed to provide an intended bending point in the connecting strip(s) to facilitate bending the cap around and mounting it. Again, another variant of design proposes making two connecting strips spaced from one another between the tube receptacle and the cap, with a tab in the middle projecting from the face of the cap.

To simplify placement of the cap on the opening of the tube, centering elements are also provided.

The tab is generally made to lie in the plane of the face of the cap when the tube is open.

Finally, it is advantageous to be able to write on the cap and/or the tab.

Other preferred embodiment variants of the test tube/reaction tube according to the invention are described hereinafter. The invention will now be explained in greater detail by way of example and with reference to the attached drawings.

DETAILED DESCRIPTION

Figure 1:
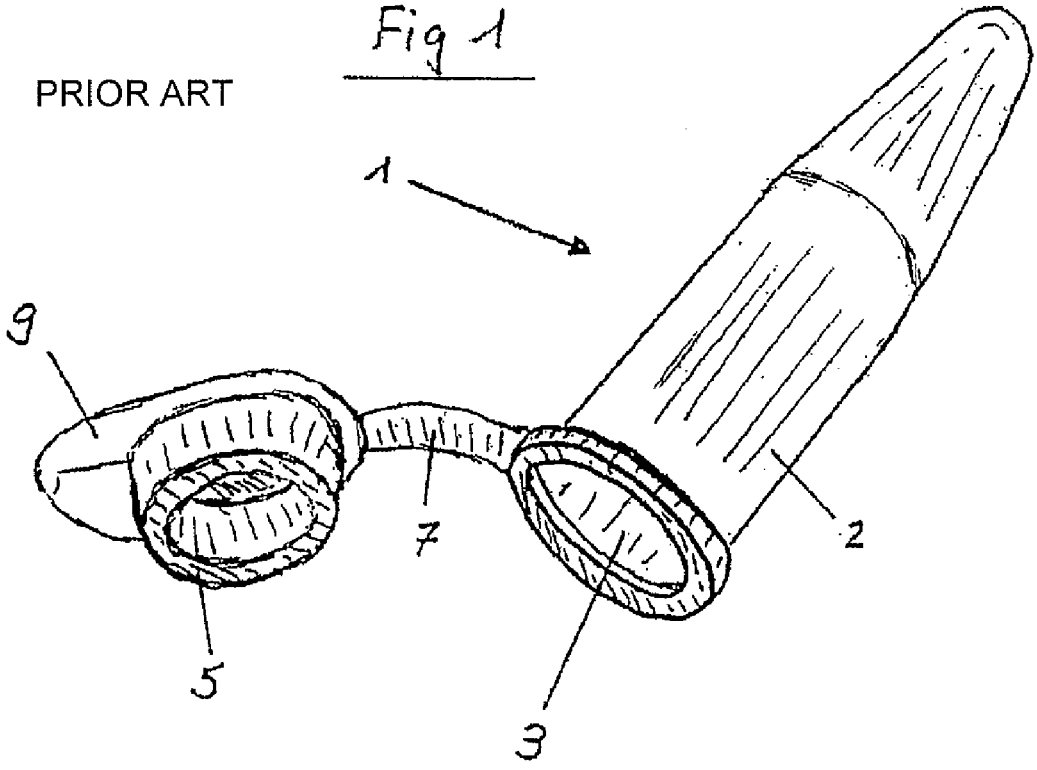
Fig 1 PRIOR ART
FIG. 1 a conventional known test/tube or reaction tube in perspective.

FIG. 1 shows in perspective a known test tube/reaction tube 1 from the prior art that has a tube body 2 with the opening 3, through which pipetted samples can be placed in the tube. To close the tube 2, there is also a cap 5 that is joined to the tube 2 by a flexible connecting strip 7. It has a grip 9 to facilitate bending back the cap 5. To close the test tube 2, it has to be taken in one hand, and the cap 5 has to be set down on the opening 3 by grasping the grip 9 with the other hand.

Besides this drawback of manipulation, it is also difficult to write on the test tube or laboratory/reaction tube known from the prior art.

Figure 2:
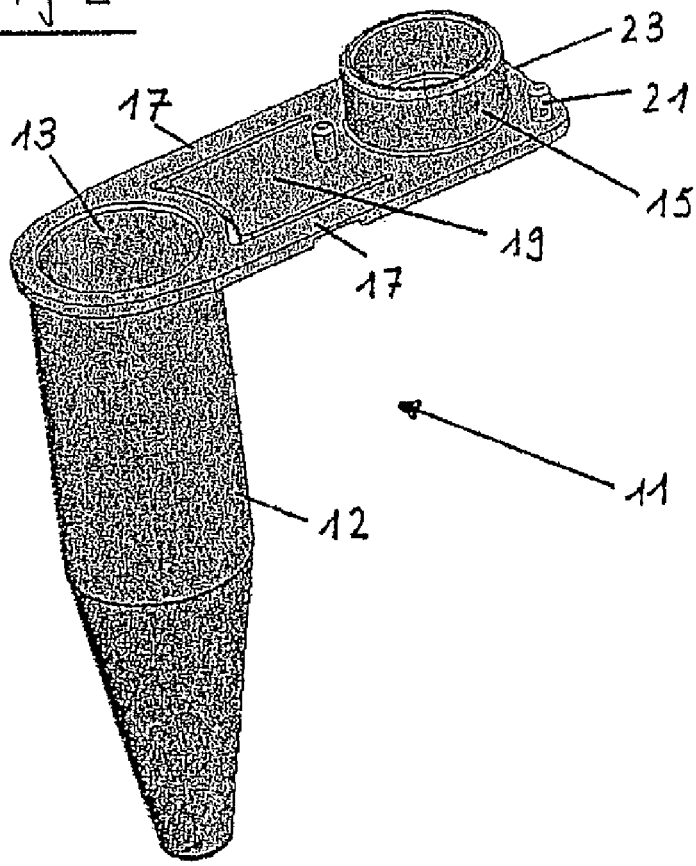
FIG. 2 a test tube or reaction tube according to the invention in perspective and in the opened state, FIGS. 3 and 4 the test tube or reaction tube of FIG. 2 in perspective and in the closed state, and FIG. 5 the test tube or reaction tube in cross section, shown particularly for better recognition of the intended bending point in the connecting strips.

Because of these drawbacks, a test tube is now proposed as described below with reference to FIGS. 2 to 5. FIG. 2 shows a test tube/reaction tube 11 according to the invention in the opened state. The actual tube 12 again has an opening 13 and there is also a cap 15 that is joined to the tube 12 through two connecting strips 17. What is novel is that a tab 19 projecting from the cap toward the tube is provided that is suitable for eliminating the initially described drawbacks. This tab 19 represents an enlargement of the face 23 of the cap 15, in the sense of a tab projecting toward the tube 12 when the test tube/reaction tube is not closed. Finally, pin-like guide elements 21 are provided, which are intended to enable centered placement of the cap 15 on the opening 13.

Figure 3:
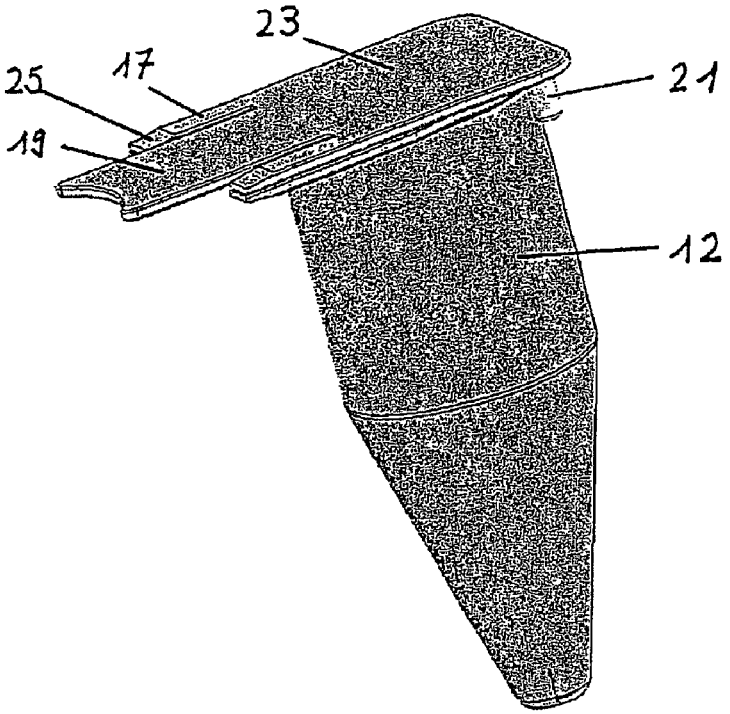
Figure 4:
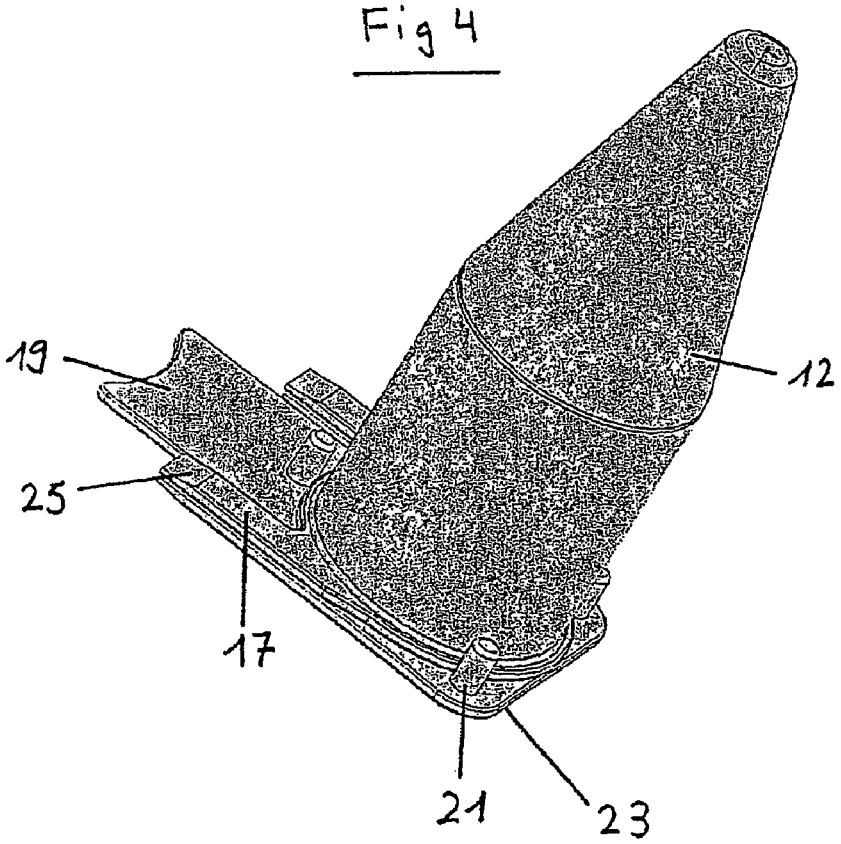
Figure 5:
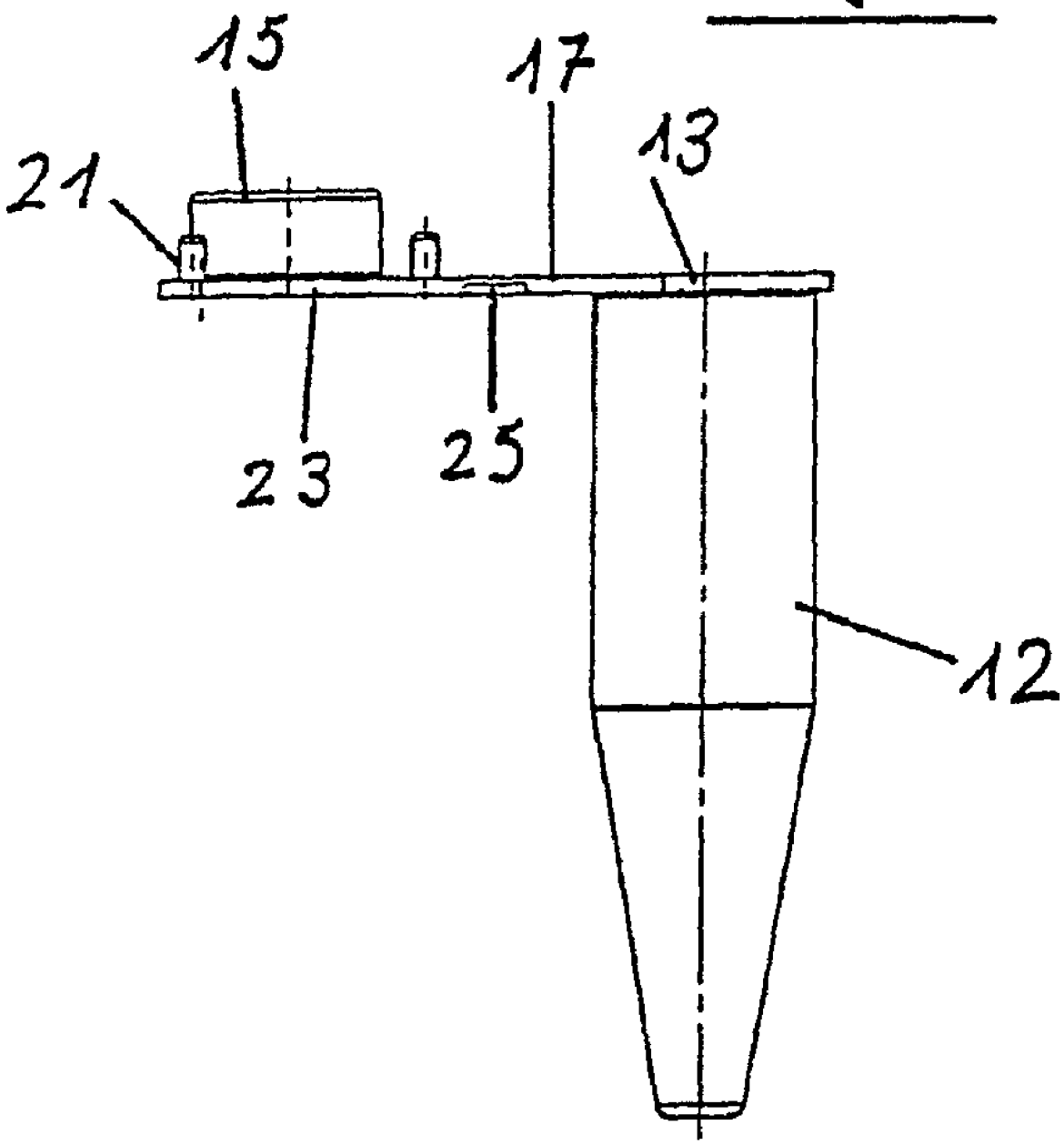

FIGS. 3 and 4 illustrate the test tube/reaction tube 11 shown in FIG. 2, in the closed state. It can be seen clearly in FIG. 3 that the cap face 23 of the cap 15 is greatly enlarged by the laterally projecting tab 19, so that after writing on this cap face formed of the two sections 19 and 23, it can be recognized clearly what sample is contained in the reaction tube 12. It is also possible, furthermore, to open the tube 12 or to lift the cap 15 with one finger, simply by pressing on the tab 19, whereupon the cap 15 automatically springs up. In other words, this process can be triggered without having to remove the tube 12 from a holder or a multiple rack.

It can also be seen clearly in FIG. 4 how the cap is centered by the guide pins 21 when it is set down on the opening 13 of the tube 12.

According to a preferred embodiment variant, it is also possible to make an intended bending point 25 in both of the connecting strips 17 running on the sides of the tab 19, so that these connecting strips always bend at the same place when they are bent over. In this regard the cross-sectional view in FIG. 5 may be pointed out, where the intended bending point 25 in the connecting strip 17 is clearly recognizable. Again, to close the opening 13 with only one finger, the cap face 23 of the cap 15 can be grasped, and because of the intended bending points 25, it is readily possible to bend the cap 15 over into the proper position to close the opening 13.

The test tubes/reaction tubes illustrated in FIGS. 2 to 5 are naturally only examples for a better understanding of the present invention. Of course, connecting strips, projecting tabs, reaction tube bodies, caps, etc., may be designed differently depending on the underlying specifications and requirements for the test tubes/reaction tubes. They may also be small test tubes or larger tubes in which larger quantities of a sample, for example a blood sample, can be placed. A wide variety of polymeric materials can also be used to manufacture the described test tubes/reaction tubes according to the invention—the type of material is governed by the requirements and chemical resistance arising from their use. Finally, the test tubes/reaction tubes defined by the invention can also be used for a broad range of applications, whether in medicine, chemistry, or biology, etc. etc.

The invention claimed is:

1. Test tube or laboratory reaction tube comprising a sample receptacle having an opening and an integrally joined cap that can be set down on the opening by bending over at least two connecting strips connecting the cap to the receptacle, wherein a tab which can be pressed with a finger for lifting the cap from the opening is provided on the cap, in the center between the connecting strips extending from a face of the cap, projecting laterally from the side of the cap in the direction of the at least two connecting strips so as to overlap a bent portion of the at least two connecting strips and project laterally beyond the at least two connecting strips after bending and setting the cap down on the opening.

2. Test tube according to claim 1, wherein a face of the cap is made to project laterally like a tab.

3. Test tube according to claim 1, wherein an intended bending point is provided in the at least two connecting strips.

4. Test tube according to claim 1, wherein centering elements are provided to guide the cap when setting it down on the opening.

5. Test tube according to claim 1, wherein the tab is at least nearly in the plane of the at least two connecting strips when the tube is open.

6. Test tube according to claim 1, wherein the cap and the tab can be written on.

7. Test tube according to claim 1, wherein the test tube is made of a polymeric material.

8. A method for storing samples, especially pipetted samples, in at least one of medicine, chemistry, biochemistry, and biology, comprising:

providing a test tube or laboratory/reaction tube having a sample receptacle with an opening and an integrally joined cap that can be set down on the opening by bending over at least two connecting strips connecting the cap to the receptacle, wherein a tab which can be pressed with a finger for lifting the cap from the opening is provided on the cap, in the center between the connecting strips extending from a face of the cap, projecting laterally from the side of the cap in the direction of the at least two connecting strips so as to overlap a bent portion of the at least two connecting strips and project laterally beyond the at least two connecting strips after bending and setting the cap down on the opening;

placing a sample in the test tube;

bending and setting the cap down on the opening such that the tab on the cap projects laterally from the side of the cap in the direction of the at least two connecting strips so as to overlap a bent portion of the at least two connecting strips and project laterally beyond the at least two connecting strips.

* * * * *